United States Patent [19]

Henricson et al.

[11] Patent Number: 4,971,658

[45] Date of Patent: Nov. 20, 1990

[54] METHOD OF INTENSIFYING THE WASHING OF A FIBER SUSPENSION

[75] Inventors: Kaj Henricson, Kotka; Olavi Pikka, Karhula; Aki Vilpponen, Espoo; Nils-Erik Virkola, Helsinki, all of Finland

[73] Assignee: A. Ahlstrom Corporation, Noormarkku, Finland

[21] Appl. No.: 363,153

[22] Filed: Jun. 8, 1989

Related U.S. Application Data

[63] Continuation-in-part of Ser. No. 133,321, Dec. 16, 1987, abandoned.

[30] Foreign Application Priority Data

Dec. 17, 1986 [FI] Finland ..... 865135

[51] Int. Cl.[5] ..... D21B 1/36; D21C 9/02

[52] U.S. Cl. ..... 162/21; 162/52; 162/60

[58] Field of Search ..... 162/18, 19, 17, 21, 162/22, 56, 60, 52

[56] References Cited

U.S. PATENT DOCUMENTS 2,355,091 8/1944 McDonald ..... 162/60
3,294,623 12/1966 Brinkley et al. ..... 162/19
4,595,456 6/1986 Andersson ..... 162/60
4,705,600 11/1987 Jacobsen ..... 162/60

FOREIGN PATENT DOCUMENTS 1164704 4/1984 Canada ..... 162/60

OTHER PUBLICATIONS

Crotogino et al., "the Principles of Pulp Washing", *Tappi*, Jun. 1987, pp. 95–103.

*Primary Examiner*—Peter Chin
*Attorney, Agent, or Firm*—Toren, McGeady & Associates

[57] ABSTRACT

The present invention relates to a method of intensifying the washing of a fiber suspension. In particular, the present invention relates to decreasing the lignin content of a fiber suspension by extracting. Lignin removal is usually carried out at a consistency of less than 3% whereby heating consumes much energy. The method of the invention allows a considerable increase in the consistency of the suspension which results in that the energy consumption is decreased to a fraction of the one required by prior art methods. A characteristic feature of the method of the invention is that dry substance and chemicals contained in the fibers are extracted at a raised pressure and temperature.

8 Claims, 4 Drawing Sheets

METHOD OF INTENSIFYING THE WASHING OF A FIBER SUSPENSION

CROSS REFERENCE TO RELATED APPLICATIONS

This is a continuation-in-part of application Ser. No. 133,321, filed Dec. 16, 1987, and now abandoned.

FIELD AND BACKGROUND OF THE INVENTION

The present invention relates to a method of intensifying the washing of a fiber suspension. In particular, the present invention relates to decreasing the lignin content of a fiber suspension by extracting the substance whereby the suspension to be treated has a higher consistency than usually and the viscosity of the fibers is kept unchanged. In other words, the strength properties of the fibers are preserved and are the same as before the washing.

In pulp production processes, chips and digesting chemicals are dosed to the reaction vessel. The chemical reacts with the wood and these digestion reactions dissolve the lignin. The products of the reaction remain partly in the chips and partly in the surrounding liquid solution.

The reaction products of the digestion, the so-called dry substance, are to be washed off from the pulp in a washing process after digestion. The pulp which was before the washing or during the washing in the form of chips has the washing or during the washing in the form of chips has been dispersed to a fiber suspension. The fraction which has not been spread into fiber suspension, separated from the pulp before, during or after the washing, is treated and returned to the process or is removed from it as the case may be. Washing liquid is introduced to the washing process of pulp in a direction opposite the flow direction of the pulp. From the beginning of the washing plant the sludge containing solid material is guided to a chemical regeneration section and to combustion.

After digestion, washing and screening, pulp is often delignified with oxygen and bleached by using different bleaching chemicals and sequences. These treatments involve reactions between the fiber material and chemicals and reaction products are produced which should be removed in the following washing phase.

The structure of the wood fiber is known to be layered. The innermost layer is hollow lumen which is surrounded by walls containing cellulose, hemicellulose and lignin. The fiber wall has different pores depending on the fiber species and type. When chemicals contact the fibers, in particular, in digestion where the fibers are in a noncompressed state, they are absorbed by penetration and diffusion even to the lumen. Thus, reactions between the wood and the chemicals take place through the whole fiber. The dissolved and soluble reaction products remain partly in the fibers. The washing phase following the reaction phase and the conditions in the washing phase in washing plants applying modern technology are such that all the soluble reaction products cannot be removed from the fibers or there is insufficient time to remove all the soluble reaction products.

It is a well known fact that by treating pulp at an increased temperature and pressure, the reaction product contained in a soluble form in the fiber can be removed. A treatment of this type provides remarkable advantages compared with conventional treatments. For example, the kappa number of the pulp to be bleached, in other words, its lignin content, is lower which saves bleaching chemicals and decreases the impact of the process on the environment. After bleaching and oxygen treatment, the same advantages are to be achieved with a treatment of the same type. However, the prior art methods have their drawbacks. Usually, lignin is removed at a consistency of less than 3%, at which consistency pulp warms up slowly and the heating requires energy many times as much as heating of pulp of, for instance, the consistency of 10%. The following example clarifies the difference. In a fiber suspension having a consistency of 3%, there is about 32 kg's liquid per one kg of fibers and in a suspension having a consistency of 10%, there is 9 kg's liquid per one kg of fibers. Thus, to heat one kg of fibers in a consistency of 3%, one needs to heat 23 kg's more liquid than in the case of heating pulp in a consistency of 10%. A more serious problem in particular in the paper manufacture is the decrease of the viscosity of the fiber suspension as illustrated in FIGS. 6 and 7. This indicates that the strength properties of the fibers decrease considerably when lignin is removed at a low consistency. For example, at the consistency of 10%, the strength properties do not change substantially.

SUMMARY OF THE INVENTION

The method of the present invention is characterized in that the fiber suspension of a consistency of over 3–30% is prewashed, fiberized after the prewashing and dry-substance, and chemicals contained in the fibers are extracted from the produced concentrated fiber suspension at an increased temperature and pressure without any chemical reaction. The consistency of prewashing and extraction is maintained at 3–30%.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described the preferred embodiments of the invention.

DESCRIPTION OF THE PREFERRED EMBODIMENTS

Figure 1:
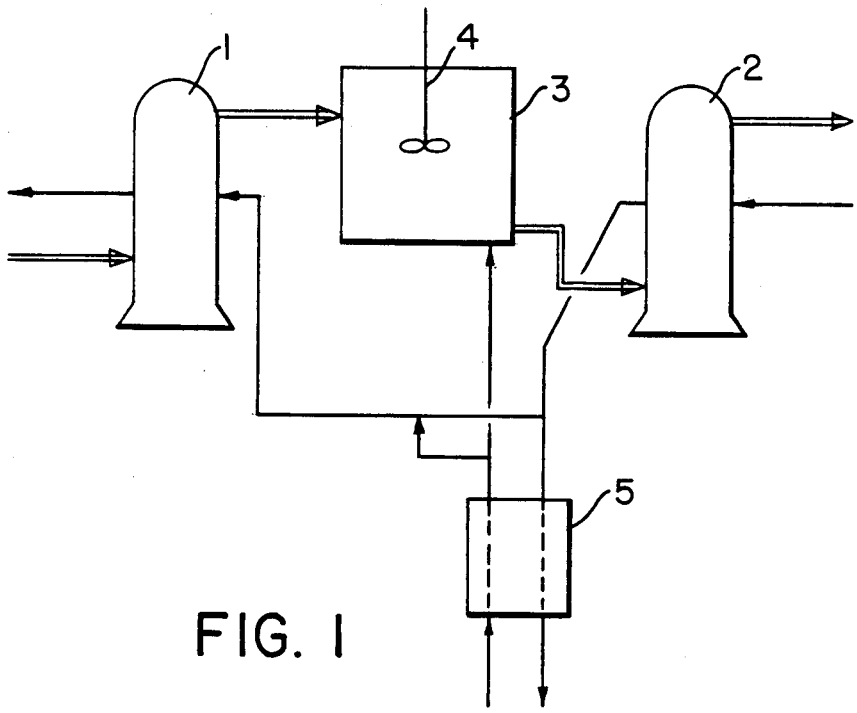
FIG. 1 is a schematic illustration of a preferred embodiment of the invention.

The embodiment illustrated in FIG. 1 comprises two pressure washers 1 and 2 which may be, for example, pressure diffusers. An extraction vessel 3, preferably provided with a mixer 4, is placed between these washers. A heat exchanger 5 is provided for recovering heat from the washing liquid from the second phase washer 2. Further, it may be necessary in some cases to provide an apparatus for recovering heat between the extraction vessel and the washer 2 to cool the pulp supplied from the extraction step to the washing step.

The method of this embodiment operates in the following way. The lignin-containing pulp suspension to be washed is supplied to the pressure washer 1 at a temperature below 100° C. in which its temperature is raised to over 100 ° C. and a pressure of 0.01–1.0 MPa by feeding it to heated fresh water and hot washing liquid displaced in the pressure washer 2. Said washing liquid in turn displaces the cool liquid used in preceding washing phases and flowing in with the pulp suspension.

From the pressure washer 1, the pulp suspension is fed to the extraction vessel in which the lignin contained in the pulp fibers is extracted to the surrounding liquid at an increased temperature of 90°–170° C. and for a period of time of 1–120 min. Tests performed have proven that lignin is separated from the fibers much more efficiently with the method of the present invention than with conventional methods even though the liquid volume in the suspension in the test had been decreased by 90%, the lignin content was tenfold, and the consistency of the pulp was 10% instead of 1%. As already mentioned above, a mixer may be provided in the extraction vessel to intensify the extraction, but the tests indicate that it is not indispensable.

From the extraction vessel, the hot suspension is supplied either directly or via a heat exchanger to the pressure washer 2 in which the hot solution containing extraction products is displaced by cool cooling water after which the extracted solution is partly supplied straight to the pressure washer 1 and partly to a heat exchanger 5 in which the heat is transferred to the fresh water supplied to the process. The heat exchanger 5 makes possible heating of fresh water and supplying heat to where it is needed, for example, to some extraction vessels. The heat exchanger 5 may be provided with an apparatus for supplying additional heat to the fresh water to be fed to the process.

The consistency of the pulp used in the test was 10%, the temperature of the pulp when it was supplied to the pressure washer 1 was 100° C., the temperature of the pulp when it was supplied to the extraction vessel was approximately 150° C. and the duration of the extraction 1 hour. In the pressure washer 2, the temperature of the pulp was decreased to approximately 50° C.

Figure 2:
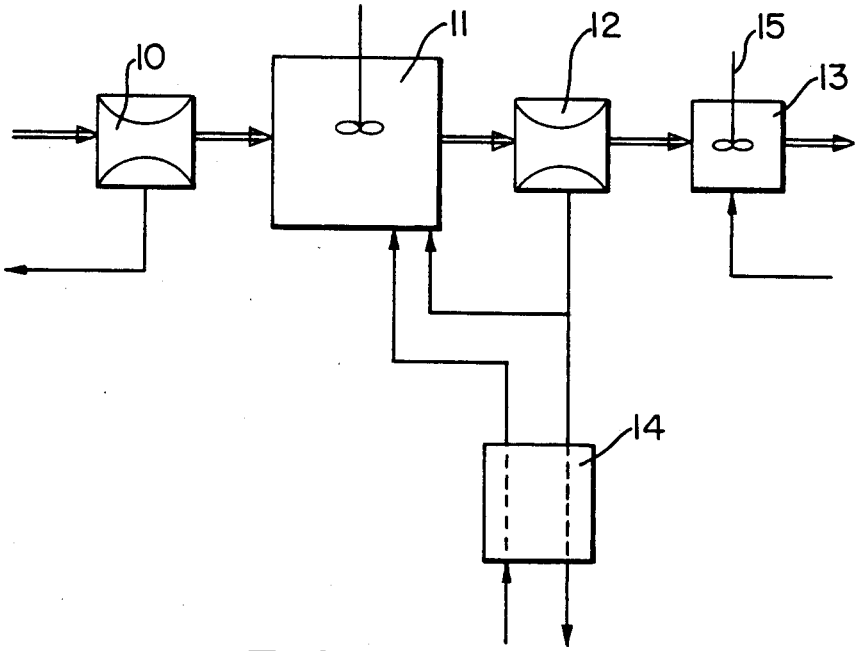
FIG. 2 illustrates an apparatus arrangement of another preferred embodiment of the invention.

In the embodiment illustrated in FIG. 2, the apparatus consists of a pressure thickener 12, a cooler 13 and a heat exchanger 14. The principle applied to this embodiment is extraction of lignin from high consistency pulp at a raised temperature and pressure. The difference compared to the previous embodiment is that extraction is carried out at a higher consistency whereby the pulp warms up in a shorter time than before and less energy is required for the heating. As indicated by the figure, a filtrate separated in a pressure thickener 10 is recycled to previous phases of the process. The filtrate separated in the thickener 12 is partly recirculated straight to the extraction vessel 11 and partly to the heat exchanger 14 in which the heat contained in the filtrate is transferred to the fresh water supplied further to the extraction vessel. Proceeding of the extraction process can be controlled by regulating the ratio of the volume of the filtrate recycled straight to the extraction vessel and the volume of the fresh water. It is also an essential feature of the method of this embodiment that the heating liquid supplied to the extraction vessel decreases the consistency of the pulp suspension. In this case, hot lignin-containing liquid is separated in the pressure thickener from the pulp discharged from the extraction vessel 11, in which thickener the consistency is raised to its initial percentage. It is, of course, possible to use a pressure washer in connection with heat recovery, in which case the cooler 13 and the pressure thickener 12 of this embodiment would be omitted. The cooler 13 in the embodiment illustrated in FIG. 2 is employed to cool the fiber suspension, but also to decrease the consistency of the suspension to 10% from the initial 30%; thus, no heat is recovered in this phase. A mixer 15 can be used to intensify the equalizing of the temperature of the pulp suspension.

Figure 3:
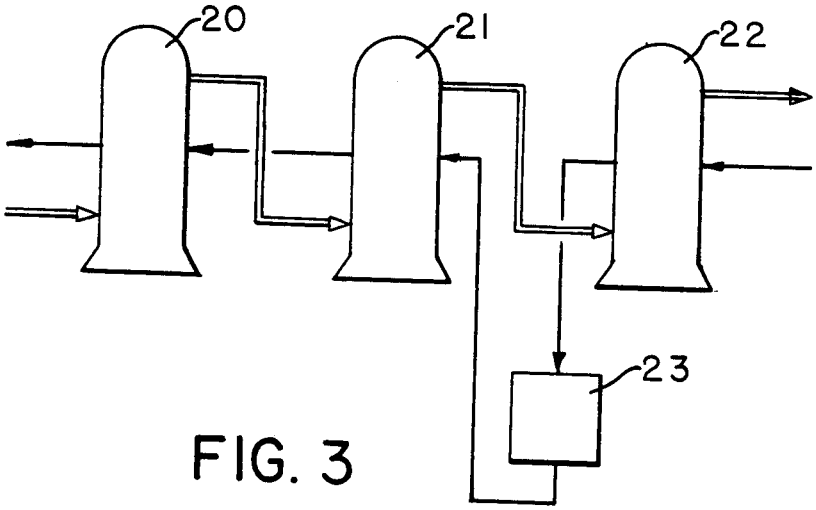
FIG. 3 illustrates a third preferred embodiment of the invention.

The apparatus according to the embodiment illustrated in FIG. 3 comprises a pressure washer 20 which can be, for example, a pressure diffuser, a pressure extraction washer 21, a second pressure washer 22 and a heater 23.

In the method according to this embodiment, the pulp suspension containing lignin is supplied to the pressure washer 20 in which its temperature and pressure are raised towards the readings required by the extraction by washing liquid supplied from the second washer 22 via the heater 23 and the extraction vessel 21 against the flow direction of the pulp. From the washer 20, the pulp suspension is supplied to the pressure extraction washer 21 in which the temperature of the suspension is raised with the washing liquid supplied from the heater 23 to a value which is advantageous for extraction. Part of the lignin-containing liquid produced in the extraction is displaced to the washer 20 and another part with the pulp suspension to the second washer 22 into which also cooling liquid is supplied which displaces the hot liquid and returns part of the heat via the heater to the extraction vessel 21. Through the whole process the consistency of the pulp suspension is meant to be kept constant, for example, 10%.

Figure 4:
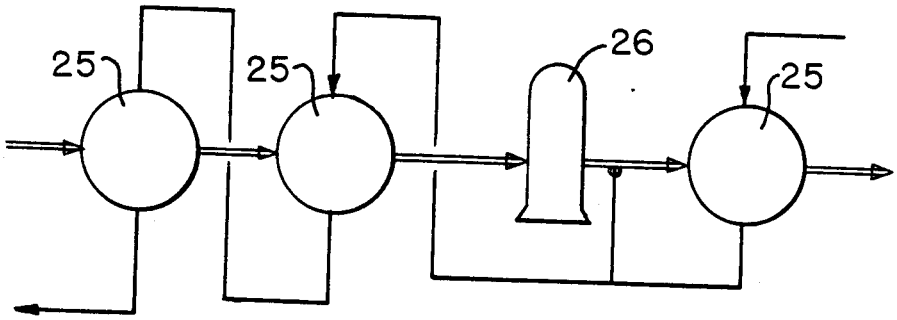
FIG. 4 illustrates a fourth preferred embodiment of the invention.

The apparatus according to the embodiment illustrated in FIG. 4 comprises washing filters 25 of suction, pressure or compression type. It is typical for a washing apparatus of the filter type that the pulp suspension has to be diluted to 1 to 3% before it is supplied to the washer. Filter washing plants have several washers 25 connected in series. The consistency of the pulp discharged from a filter washing plate is usually 10–30% if the pulp is not diluted. Extraction phase 26 of a filter washing plant can be installed after a washing phase or all the washing phases. It is advantageous to carry out the extraction at the discharge consistency of the filter in order to avoid the use of large tanks and stores.

Figure 5:
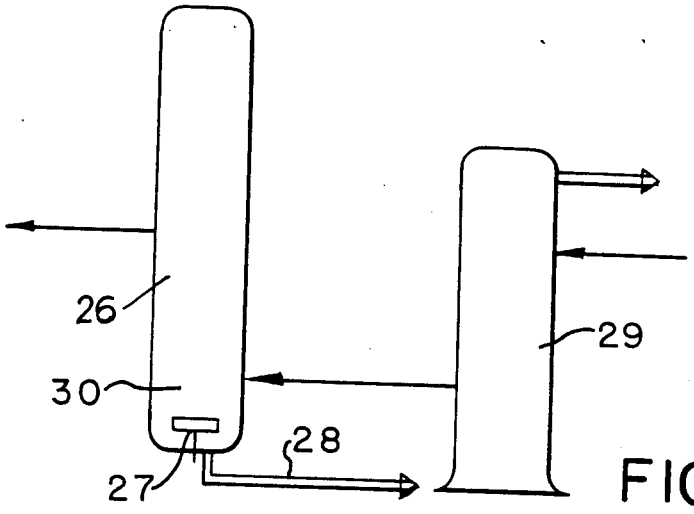
FIG. 5 illustrates a fifth preferred embodiment of the invention.

The apparatus according to the embodiment illustrated in FIG. 5 comprises a digester 26, a washing compartment 30 connected to it and a discharge device 27. The pulp is supplied from the digester in the form of fiber pulp via pipe 28 to a washer 29 which can be, for instance, a pressure diffuser. The extraction process is carried out as follows: when the wood chips have been digested, the cellulose still in the form of chips is prewashed in the washing compartment 30 of the digester. After prewashing, the cellulose is fiberized to fiber pulp in the discharge device 27 or in the pipe 28 and is supplied to the washer 29 in which the fiber pulp is washed at a raised temperature and pressure.

It is to be noted that after the chips have been cooked so that lignin has dissolved from the chips loosening the fiber bonding, the pulp is still in the form of chips as there has been no force that could have separated the fibers from each other. The pulp stands still in the cooking vessel. Thus, without any fiberizing action, the pulp looks like chips, that is, pulp is in chip form. Now if the pressure in the cooking vessel is rapidly lowered, the liquid between the fibers in the "chips" boils and evaporates and the steam pushes the fibers apart, whereby the fibers are separated and the pulp is converted into fiber form. At the same time, the formation of steam requires plenty of energy, whereby the temperature is being lowered. It is also possible to lower the temperature rapidly, whereby the pressure is also lowered so that both phenomena, lowering of pressure and/or temperature, belong together.

Figure 6:
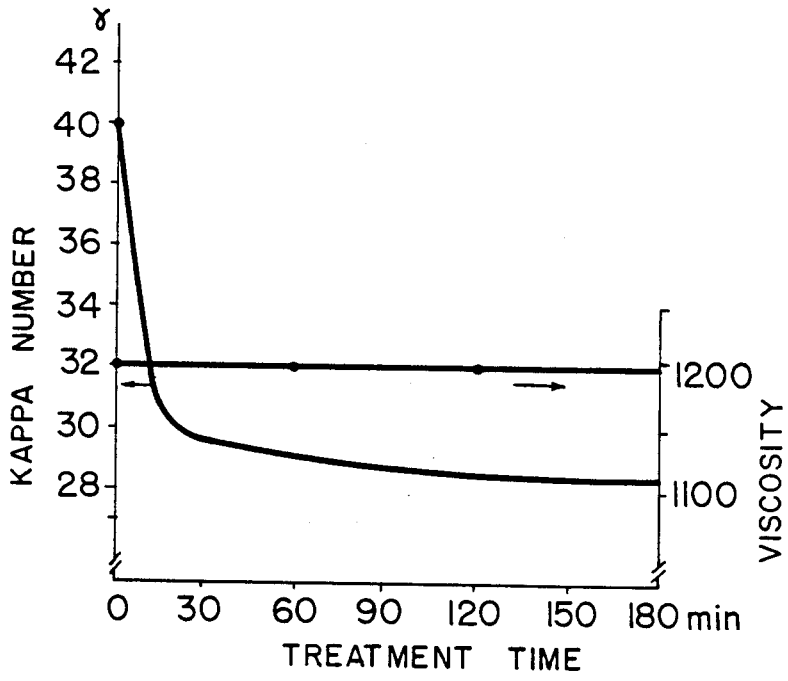
FIGS. 6 and 7 illustrate the viscosity of pulp as a function of the treatment time in extraction.
Figure 7:
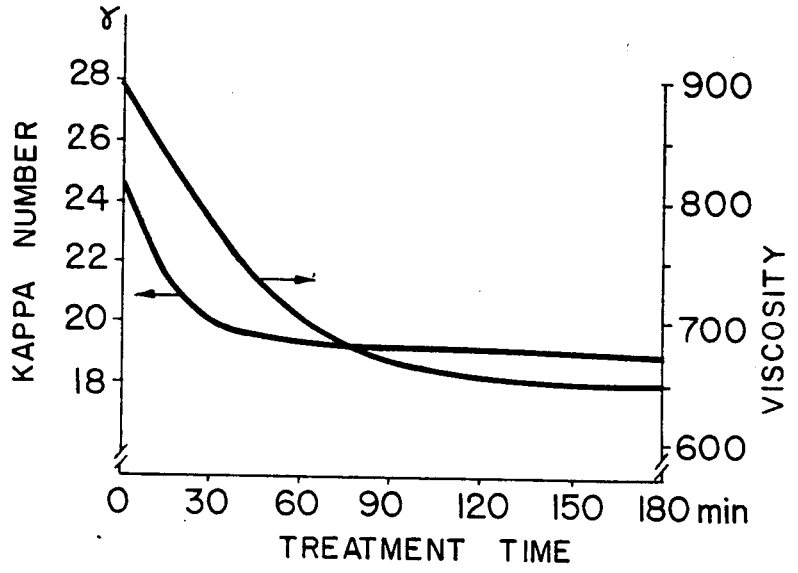

FIGS. 6 and 7 illustrate the results of laboratory tests. The left vertical axis in the figures illustrates the kappa number of the pulp and the right vertical axis the viscosity of the pulp. The horizontal axis illustrates treatment time. In the treatment illustrated in FIG. 6, the consistency of the pulp was 10% and the temperature 155° C. In the treatment of FIG. 7, the consistency of the pulp was 1% and the temperature 155° C. In both cases, the pulp sample had been washed pine sulphate pulp from a mill.

The curves in FIGS. 6 and 7 indicate that the viscosity of the pulp does not decrease at the consistency of 10% (FIG. 6), whereas at the consistency of 1%, the viscosity decreases very sharply. As the viscosity of the pulp is proportional to the stiffness of the fibers, in other words, to their strength, their strength properties can be seen to deteriorate remarkably during washing at a low consistency. The kappa number of the pulp decreases almost as much in both cases, in the treatment at 10% from 41 to 30 (FIG. 6) and in the treatment at 1% from 26 to 19 (FIG. 7).

It is to be noted that the alkali mentioned in the following examples is a residue from the cooking process, said alkali not having been totally washed away in the prewashing stage. An ordinary amount of residual alkali after the cooking stage is about 10 g/l and after the prewashing stage suspension contains 0.5–5 g/l alkali so that by the prewashing stage, we have removed about 9.5–5 g/l alkali from the suspension. The alkali, however, is a vital factor for achieving the results explained, the alkali practically does not react chemically, but makes the fibers swell physically, whereby the dry substances and chemicals are able to extract from inside the fibers. The chemicals and dry substances mentioned in the claims are the residues from chemical reactions during the digesting process. Thus, the alkali is present in the suspension during the extraction, but does not take an active chemically reactive part in the extraction process.

It is also to be noted that when applying the method in accordance with the present invention, no additional chemicals are needed in the washing stage.

EXAMPLE 1

Figure 8:
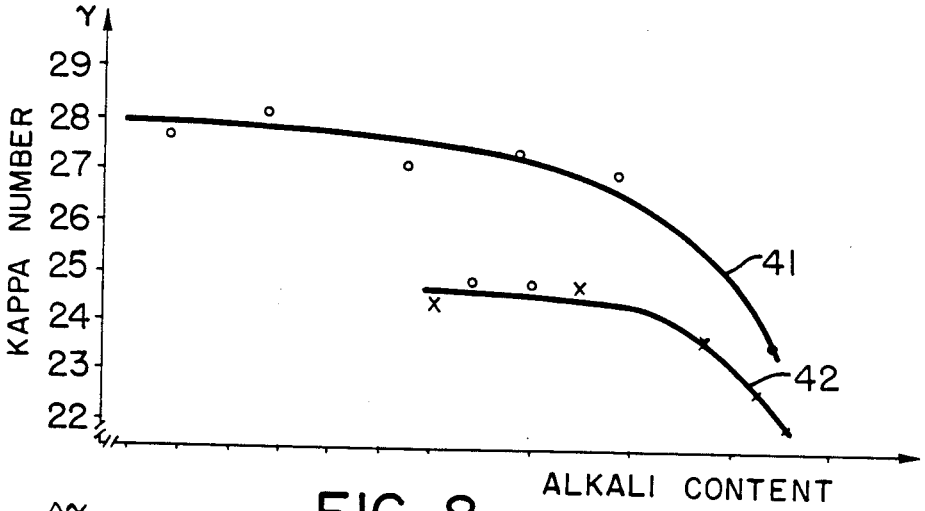
FIGS. 8–10 illustrate the results of tests performed.

The pulp was digested in a laboratory to a kappa number of 30. The pulp was prewashed at a temperature of 150 ° C. under pressure while still in the chip form (i.e., with the lignin dissolved, but the chips not yet separated into fibers). It was found out that the kappa number began to decrease rapidly at the residual alkali content of 1–2 g/l as illustrated in FIG. 8 by curve 41 (horizontal axis: residual alkali content in extraction, vertical axis: change of kappa number). After prewashing, the pressure in the laboratory digester was suddenly dropped which resulted in the cellulose still in the form of chips being changed to fiber suspension (the pulp in chip form was fiberized). The digester was again pressurized and washing was carried out at a raised temperature of 150° C. The kappa number decreased further by five units (curve 42). The consistency was all the time 10%.

This example showed that extraction is most successful when the digested pulp is fiberized to fiber suspension and the extraction is carried out at a raised temperature.

EXAMPLE 2

Pulp was digested, prewashed and fiberized in the same way as in Example 1. Extraction was carried out at the consistency of 10% at a raised temperature.

Figure 9:
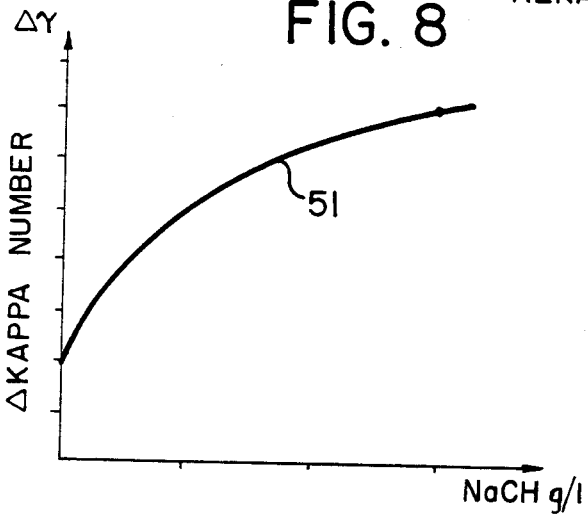

Curve 51 in FIG. 9 (horizontal axis: volume of residual NaOH, vertical axis: change of kappa number) indicates that it is advantageous to wash the pulp in alkaline conditions at least when digestion has been carried out by the sulfate method as in this example. With pine sulfate pulp, a decrease of 8 kappa units was achieved by an extraction temperature of 150° C. and an extraction time of 30 minutes. In the example, the initial kappa number was approximately 30. Thus, washing can well be done with ordinary alkaline washing waters otherwise also used in a sulfate pulp mill.

EXAMPLE 3

Figure 10:
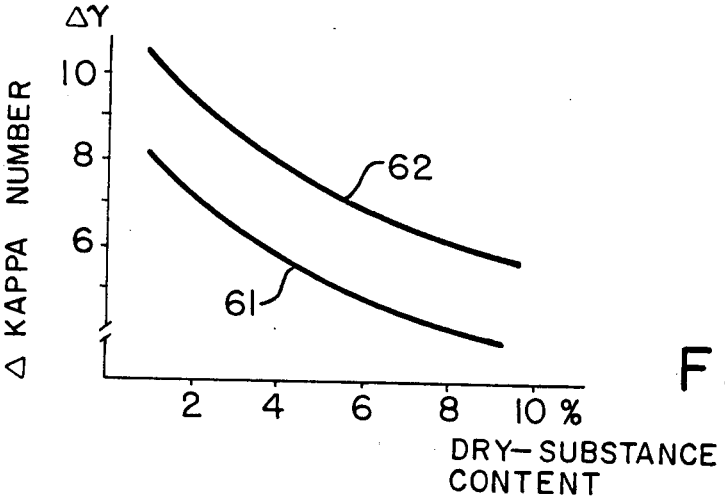

FIG. 10 (horizontal axis: dry-substance content of the extraction solution, %; vertical axis: change of kappa number) illustrates the results of a third test. Pine sulfate pulp was at first digested under laboratory conditions and prewashed in the chip form at a raised temperature. Extraction was carried out at 150° C., extraction time 30 minutes. The extraction in the chip form decreased the kappa number as illustrated by curve 61. When the pulp was fiberized before the extraction (curve 62), the kappa number decreased rapidly (not illustrated in the figure) and the decrease was more intense. The difference was approximately two units. The test series showed that a low dry-substance content in the extraction is advantageous.

The share of bleaching on the effluent load of the whole sulfate process is directly proportional to the kappa number. A decrease of the kappa number from 30.5 to 24 decreases the effluent load by 20%. Also, consumption of bleaching chemicals is proportional to the kappa number and also decreases by 20%.

As the five embodiments described above show, there are quite a number of apparatus combinations for carrying out the method of the present invention which is extraction of lignin from a fiber suspension at a raised temperature and pressure without adding any washing chemicals and substantially without any chemical reactions during washing of a pulp suspension having a consistency higher than 3%. In addition to the economic point of view mentioned at the beginning, the volume of water used in the process also decreases as the high consistency technology available decreases the need for water to a fraction as compared with the amount required by previous methods. Further, considerable savings in the apparatus are to be gained as the consistency of the pulp need not alternatingly be increased or decreased, but pulp of medium consistency can be treated the whole time. Also, as the volume of water per pulp unit decreases the side of the apparatus can be smaller while the volume of the treated pulp increases.

While specific embodiments of the invention have been shown and described in detail to illustrate the application or the inventive principles, it will be understood that the invention may be embodied otherwise without departing from such principles.

What is claimed is:

1. A method of intensifying washing of a fiber suspension after digestion, said suspension containing residual alkali in a way so as to preserve the strength properties of fibers in said fiber suspension so that they are the same before washing and after washing, comprising the steps of:

maintaining the consistency of said pulp suspension throughout the method at a high consistency range of 3–30%; prewashing said pulp suspension in a pressurized washer, said pulp suspension is prewashed with a hot aqueous washing liquor sufficient for reducing the alkali concentration to no more than 5 g/l and raising the temperature of the pulp suspension above 100° C.

2. The method as cl aimed in claim 1, wherein said pulp suspension is prewashed in a chip form.

3. The method as claimed in claim 1, wherein said pulp suspension is prewashed in a fiber

4. The method as claimed in claim 3, wherein said pulp suspension is fiberized after the prewashing by dropping the pressure.

5. The method as claimed in claim 3, wherein said pulp suspension in the chip form is fiberized after the prewashing by agitating the suspension.

6. The method as claimed in claim 1, wherein the duration of the extraction is 10–30 minutes.

7. The method as claimed in claim 1, wherein said suspension to be treated contains 1 g/l residual alkali.

8. The method as claimed in claim 1, wherein the consistency of said pulp suspension is maintained throughout the method at a high consistency range of 10–30%.

* * * * *